US009158283B2

(12) United States Patent
Cornibé et al.

(10) Patent No.: US 9,158,283 B2
(45) Date of Patent: Oct. 13, 2015

(54) REVERSER FOR TIMEPIECE

(71) Applicant: Audemars Piguet (Renaud et Papi) SA, Le Locle (CH)

(72) Inventors: Sylvain Cornibé, Clarafond Arcine (FR); Michel Belot, Villiers (CH); Jérôme Kirchhof, Neuchâtel (CH)

(73) Assignee: Audemars Piguet (Renaud et Papi) SA, Le Locle (CH)

( * ) Notice: Subject to any disclaimer, the term of this patent is extended or adjusted under 35 U.S.C. 154(b) by 0 days.

(21) Appl. No.: 14/594,276

(22) Filed: Jan. 12, 2015

(65) Prior Publication Data

US 2015/0198925 A1 Jul. 16, 2015

(30) Foreign Application Priority Data

Jan. 15, 2014 (EP) ..... 14151337

(51) Int. Cl.
*G04B 5/02* (2006.01)
*G04B 5/14* (2006.01)
*G04B 11/00* (2006.01)

(52) U.S. Cl.
CPC .. *G04B 5/02* (2013.01); *G04B 5/14* (2013.01); *G04B 11/006* (2013.01)

(58) Field of Classification Search
CPC ..... G04B 5/02; G04B 5/04; G04B 5/10; G04B 5/14; G04B 11/006
USPC ..... 368/148, 208
See application file for complete search history.

(56) References Cited

U.S. PATENT DOCUMENTS

| | | | | |
|---|---|---|---|---|
| 3,306,025 | A * | 2/1967 | Kocher | 368/148 |
| 6,409,379 | B1 * | 6/2002 | Gabathuler et al. | 368/150 |
| 2007/0237035 | A1 * | 10/2007 | Helfer et al. | 368/147 |
| 2010/0135127 | A1 * | 6/2010 | Born et al. | 368/127 |

FOREIGN PATENT DOCUMENTS

| | | | |
|---|---|---|---|
| CH | 321237 | A | 4/1957 |
| DE | 952879 | C | 11/1956 |
| EP | 1 046 965 | A1 | 10/2000 |
| EP | 2 515 186 | A1 | 10/2012 |
| FR | 1079576 | A | 12/1954 |
| FR | 1 341 404 | A | 10/1963 |

* cited by examiner

*Primary Examiner* — Vit W Miska
(74) *Attorney, Agent, or Firm* — Drinker Biddle & Reath LLP

(57) ABSTRACT

A reverser for a timepiece including a first input moving part having a first receiving toothing and integral with a first transmission toothing, a second input moving part having a second receiving toothing and integral with a second transmission toothing, a first satellite cooperating with the first transmission toothing configured to rotate in a single direction, a second satellite cooperating with the second transmission toothing configured to rotate in a single direction, the satellite being freely rotatable relative to the first satellite, a satellite carrier carrying the second satellite and an output moving part integral with the satellite carrier in which the first satellite is carried by the satellite carrier.

12 Claims, 8 Drawing Sheets

REVERSER FOR TIMEPIECE

This application claims benefit of the priority application, European Patent Application No. 14151337.4, filed on Jan. 15, 2014, which is incorporated by reference herein in its entirety.

FIELD OF THE INVENTION

The present invention relates to a reverser for a timepiece, in particular for a self-winding watch.

BACKGROUND OF THE INVENTION

French patent no. 1,079,576 published in 1954 relates to a self-winding device for a clockwork mechanism. In said device, a winding wheel drives an output wheel, depending on the direction of rotation thereof, in one or the other of the following ways:

- either by means of a pinion which it carries and which acts as a satellite engaged with another pinion meshing with the output wheel,
- or by meshing with another wheel likewise carrying a pinion which forms another satellite engaged with another pinion meshing with the output wheel.

German patent no. 952,879 published 1956 describes a freewheel clutch for a self-winding watch. This clutch comprises two input wheels driven in opposite directions by a winding wheel. Each of these input wheels is integral with a pinion around which a satellite forming a pawl which is mounted on a lower wheel can move. The two lower wheels mesh with one another and one of them is integral with an output wheel. Thus, depending on the direction of rotation of the winding wheel, the output wheel is driven:

- either by a first input wheel, a first pinion, a first satellite and a first lower wheel which forms a first satellite carrier, said first lower wheel being engaged with a second lower wheel which is integral with the output wheel;
- or by a second input wheel, a second pinion, a second satellite and the second lower wheel, the latter carrying the second satellite carrier and being integral with the output wheel.

In other words, in this German patent, each satellite is mounted on a lower wheel, the lower wheels serve as a satellite carrier, they mesh with one another, always rotate in opposite directions and just one, the one rotating in the rewinding direction of the spring barrel, is integral with the output wheel.

BRIEF DESCRIPTION OF THE INVENTION

The above-stated mechanisms in particular have the drawback of occupying a large amount of space and it would seem that despite almost 60 years having elapsed since the publication thereof, no-one has yet managed satisfactorily to solve this problem of space.

The applicant's inventors have now succeeded in developing a substantially smaller reverser.

One particular feature of this mechanism, in comparison with the clutch of the above-stated German patent DE 952,879, is that it comprises just one satellite carrier for its two satellites.

More specifically, the reverser according to the invention comprises:

- a first input moving part comprising a first receiving toothing and integral with a first transmission toothing;

- a second input moving part comprising a second receiving toothing and integral with a second transmission toothing;
- at least one first satellite cooperating with the first transmission toothing in such a manner as to be capable of rotating in a single direction;
- at least one second satellite cooperating with the second transmission toothing in such a manner as to be capable of rotating in a single direction, said satellite being freely rotatable relative to the first satellite;
- a satellite carrier carrying the second satellite;
- an output moving part integral with the satellite carrier;

and is characterised in that the first satellite is also carried by the single satellite carrier.

The reverser according to the invention furthermore has the advantage of allowing the majority of the component parts thereof to be arranged coaxially.

The advantageous features of the reverser according to the invention are stated in the following points:

Notably, the first and second input moving parts of the reverser are coaxial.

Likewise, the first and second transmission toothings of the reverser may be internal toothings. In this case, the first and second satellites may preferably also be coaxial.

According to another embodiment of the present invention, the satellite carrier of the reverser is coaxial with the output moving part.

Notably, the satellite carrier of the reverser is coaxial with the first input moving part and/or the second input moving part.

According to another embodiment of the present invention, the first and second satellites of the reverser may have separate pivot axes.

Notably, the first and second satellites are arranged to cooperate with their respective second transmission toothing so as to rotate in opposite directions.

Likewise notably, the first and second input moving parts, the satellite carrier and the output moving part are all coaxial.

According to still another embodiment of the present invention, the satellite carrier carries a plurality of pairs of first and second satellites.

The invention also relates to a self-winding watch comprising a reverser as previously defined, said watch furthermore possibly comprising a mechanism capable of driving the input moving parts in rotation in opposite directions.

BRIEF DESCRIPTION OF THE DRAWINGS

Other characteristics and advantages of the invention will now be described in detail in the following description which is provided with reference to the appended drawings which show schematically.

DETAILED DESCRIPTION OF THE INVENTION

In the present specification, a "reverser" is taken to mean a mechanism which makes it possible to convert the rotational movements in two directions of a moving part into a rotational movement in a single and invariable direction.

Figure 1:
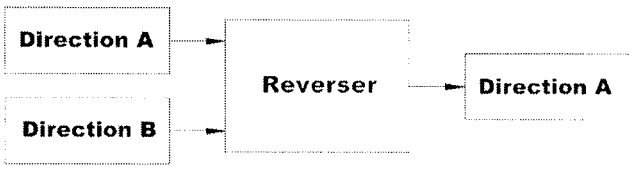
FIG. 1: a diagram showing the principle of operation of the mechanism which, for the purposes of the present invention, is designated "reverser"

The principle of operation such a mechanism is illustrated by FIG. 1.

Figure 2:
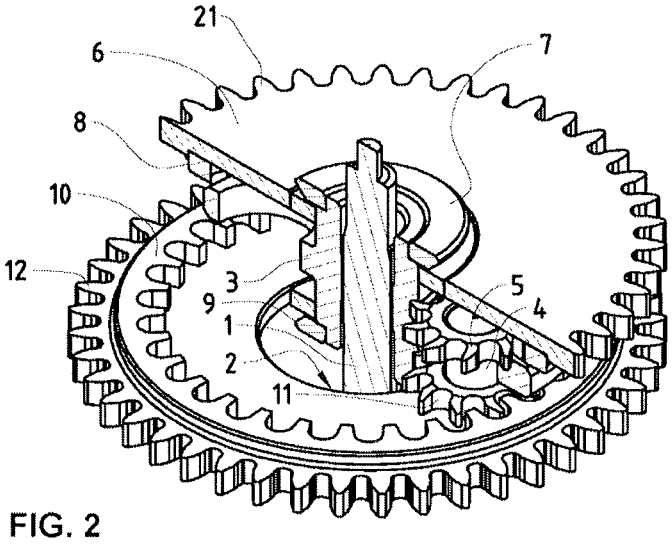
FIG. 2: a reverser according to a first embodiment of the invention in perspective and sectional view from above.
Figure 3:
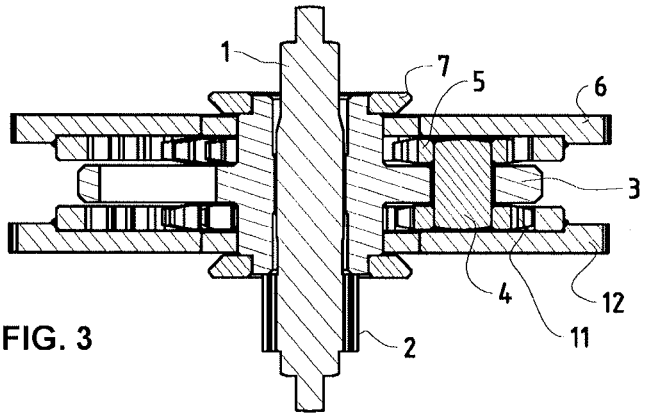
FIG. 3: the reverser of FIG. 2 in sectional side view.

FIGS. 2 and 3 show a first embodiment of the reverser according to the present invention. As can be seen, said reverser comprises a shaft 1, a lower end of which comprises a lower toothing 2, in order to constitute an output moving part capable of being connected in known manner, generally by a kinematic chain which is not shown, to the spring barrel of a timepiece to be rewound.

On the shaft 1, above the lower end thereof, a satellite carrier 3 has been driven on from above which assumes the overall form of a hollow cylinder provided with a portion which forms a disc in such a manner that the plane of said disc is perpendicular to the longitudinal axis of the hollow cylinder. The bottom of said cylinder abuts against the lower toothing 2 of the shaft 1. The portion which forms the disc is passed through longitudinally by a peg 4 onto the upper part of which has been driven a first satellite 5. The peg 4 is freely rotatable relative to the portion which forms the disc of the satellite carrier 3 and about an axis parallel to that of the hollow cylinder.

On the top of the hollow cylinder of the satellite carrier 3, a first input wheel 6 is freely rotatably mounted and held in place axially by a locking ring 7, the lower face of which first input wheel comprises a first internal toothing 8 which may be the toothing of a ring attached in known manner (welding, brazing etc.). Said internal toothing 8 is provided to cooperate with the first satellite 5.

On the bottom of the hollow cylinder of the satellite carrier 3, a second input wheel 12 is freely rotatably mounted and held in place axially by a locking ring 9, the upper face of which second input wheel comprises a second internal toothing 10 which may be the toothing of a ring attached in known manner (welding, brazing etc.).

A second satellite 11 is arranged freely rotatably about the peg 4, being sandwiched between, from below, the second input wheel 12 and, from above, the portion which forms the disc of the satellite carrier 3. Said second satellite 11 is provided to cooperate with the second internal toothing 10.

Figure 4:
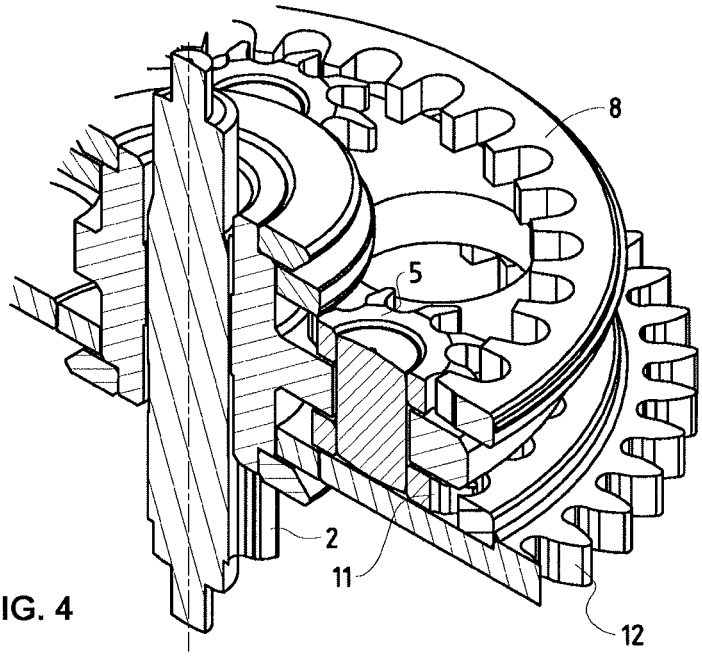
FIG. 4: a cutaway detail of FIG. 2.

Cooperation between the satellites 5 and 11 and, respectively, the internal toothings 8 and 10 can be seen in FIG. 4. The satellites 5 and 11 form pawls, i.e. they have teeth, the asymmetrical shape of which is provided to allow them to rotate only in a single direction. Such a shape is well-known to a person skilled in the art and is represented, in particular, in FIGS. 3 and 4 of the above-stated French patent (parts numbered 4 and 5). As a variant, it is possible to provide that it is the teeth of the internal toothings 8 and 10 which form pawls, like the teeth of wheels 30 and 40 in FIG. 1 of the above-stated German patent.

It is also possible to provide for both an internal toothing and the teeth of a satellite to have specific shapes which cooperate with one another in order to permit rotation in one direction and locking in another direction, as taught by Swiss patent no. 321,237.

Thus, for a given direction of rotation of the internal toothing 8, meshing and therefore driving of the satellite 5 in rotation is possible, whereas in the other direction said satellite locks.

Likewise, for a given direction of rotation of the internal toothing 10, meshing and therefore driving of the satellite 11 in rotation is possible, whereas in the other direction said satellite locks.

The unidirectional satellites 5 and 11 are arranged in reversed manner and they are not identical, such that one input wheel can only rotate in one direction and the other can only rotate in the opposite direction. More particularly, the shape of the teeth of the two satellites 5 and 11 is reversed so as to ensure rotation in one direction and locking in the other direction.

Operation

Figure 5:
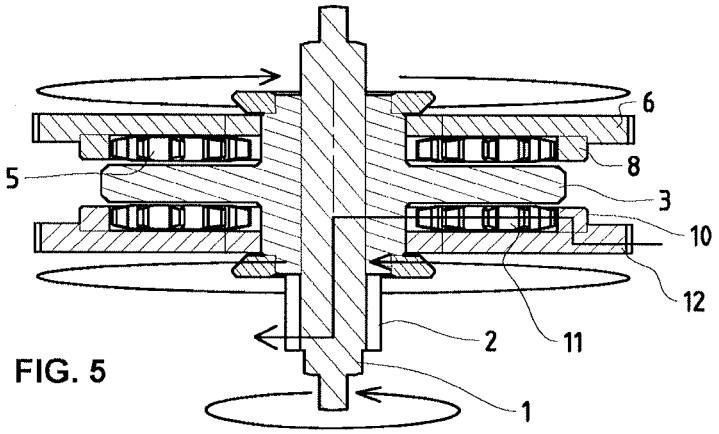
FIGS. 5 and 6: illustrations of the operation of the reverser according to FIGS. 2 to 4.
Figure 6:
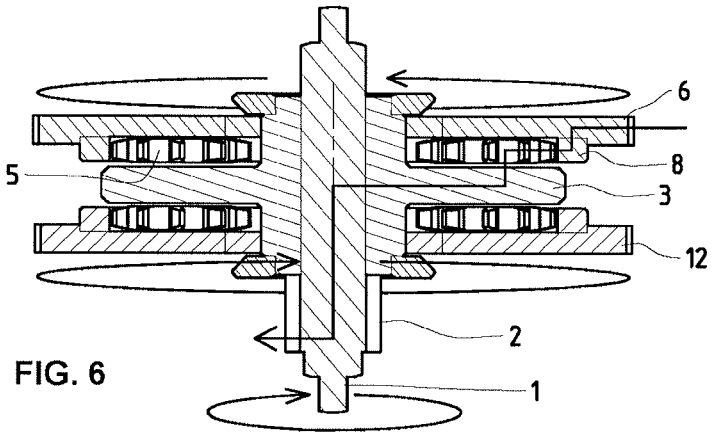

Operation of the reverser according to the invention is illustrated in FIGS. 5 and 6.

Upstream of the reverser according to the invention there is provided a geartrain which compels the input wheels 6 and 12 to rotate in opposite directions.

In FIG. 5, the shaft 1 is provided to rotate only in the usual direction of the hands of a watch, or "clockwise" direction. The first input wheel 6 is driven in counter-clockwise direction and must therefore have no effect on the shaft 1. To achieve this, when said input wheel rotates it drives the first internal transmission toothing 8, which is engaged with the first satellite 5. The latter is arranged appropriately such that rotation of the internal toothing 8, and therefore of the toothed wheel 6, allows the satellite to mesh with the internal toothing 8. Rotation of the latter will then bring about rotation of the satellite 5 and of the peg 4 about the longitudinal axis of the latter. Such rotation proceeds independently of the satellite carrier 3 and has no effect on it. The satellite 5 is said to rotate "in thin air".

At the same time, the second input wheel 12 rotates in the opposite direction to that of the input wheel 6, that is to say in the one direction in which the shaft 1 can rotate. The arrangement or orientation of the satellite 11 is such that it cannot mesh with the second internal transmission toothing 10 integral with the input wheel 12 and consequently, it cannot rotate about itself and locks. It is then driven in rotation by the second internal toothing 10, not about the longitudinal axis of the peg 4, but about the longitudinal axis of the shaft 1. In this rotational movement, the satellite 11 then drives the peg 4 in rotation and therefore the assembly of the satellite carrier 3 together with the shaft 1 integral with the latter. Accordingly, the input wheel 12, the second internal toothing 10, the satellite 11, the peg 4, the satellite carrier 3 and the shaft 1 behave as if they were just a single part.

FIG. 6 shows the reverse situation. This time, it is the input wheel 6 which rotates in the direction in which the shaft 1 is intended to rotate. The satellite 5 cannot mesh with the first internal transmission toothing 8. Locking which prevents the satellite 5 from rotating about itself therefore occurs. Rotation of the input wheel 6 then brings about rotation of the satellite 5, the peg 4, the satellite carrier 3 and the shaft 1 about the longitudinal axis of the shaft 1. In this case, the input wheel 6, the first internal toothing 8, the satellite 5, the peg 4, the satellite carrier 3 and the shaft 1 behave as if they were just a single part.

Thus, whatever the direction of rotation of the input wheels 6 and 12, the shaft 1 is always driven in rotation in the same direction.

Figure 9:
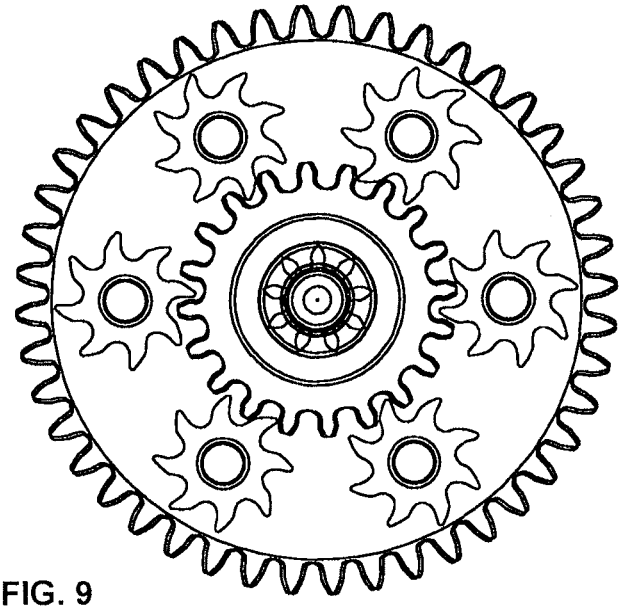
FIGS. 9 to 11: a variant of the reverser according to the first embodiment of the invention, in plan view, sectional side view and sectional side and perspective view.
Figure 10:
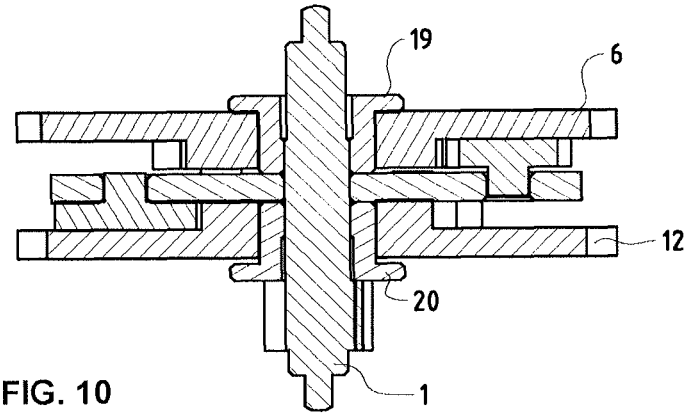
Figure 11:
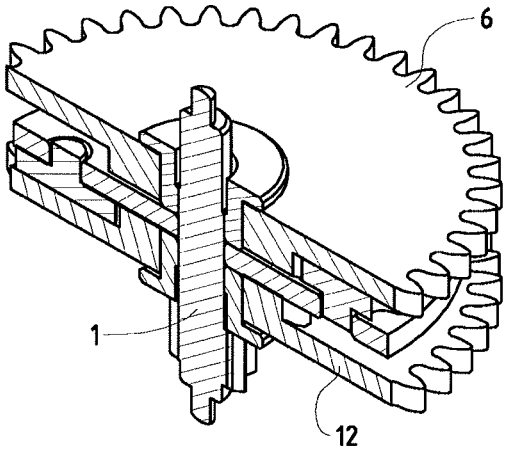

FIGS. 9 to 11 show a variant of the reverser according to the invention, in which the input wheels 6 and 12 are attached by means of bushes 19 and 20 integral with the shaft 1, the satellites, here six in number, rotating freely relative to the satellite carrier and being axially confined on one side by the satellite carrier and on the other side by an input wheel 6 or 12.

Figure 7:
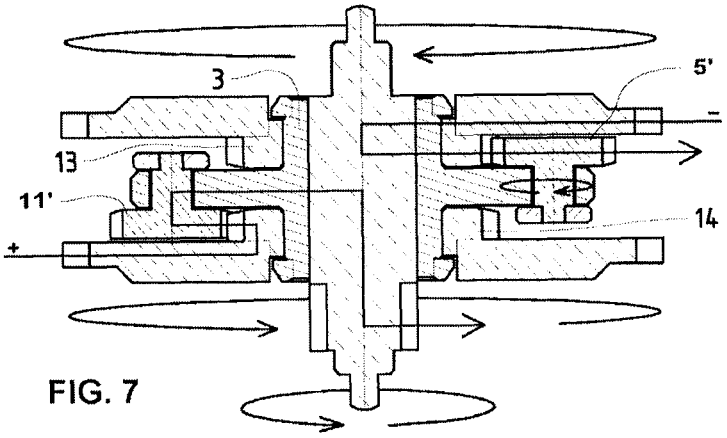
FIG. 7: a reverser according to a second embodiment of the reverser according to the invention in sectional side view.
Figure 8:
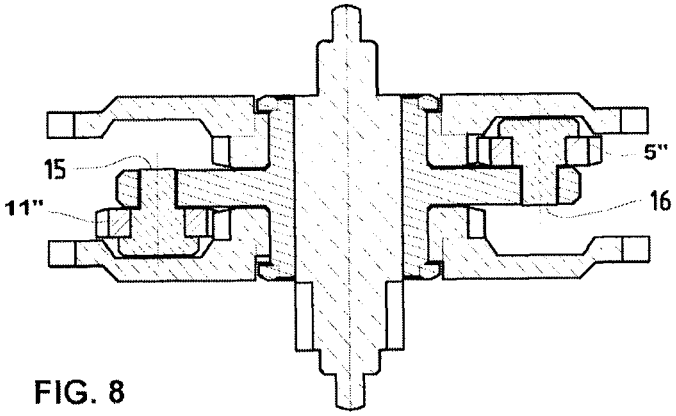
FIG. 8: a variant of the reverser of FIG. 7 in sectional side view.

FIGS. 7 and 8 show a second embodiment of the present invention which differs from the first embodiment as follows:

- the first and second transmission toothings are no longer internal toothings but external toothings 13 and 14, for example provided on pinions integral with the first and second input wheels 6 and 12; and
- the first and second satellites 5', 11' are no longer coaxial: they are offset angularly, preferably diametrically opposed on the portion which forms a disc of the satellite carrier 3.

These differences aside, the reverser operates in the same way as in the first embodiment, the assembler of the mechanism merely needing to ensure that the asymmetrical teeth of the satellites are appropriately oriented.

In FIG. 7, it can be seen that the satellites 5' and 11' are formed by a single part with one portion forming a peg passing through the portion which forms the disc of the satellite carrier. The bottom (satellite 5') or the top (satellite 11') of the respective peg is provided with a washer to keep the respective satellite 5' or 11' on the satellite carrier 3.

In FIG. 8, it can be seen that the satellites 5", 11" are mounted pivotably about studs 15, 16 driven into holes provided in the portion which forms the disc of the satellite carrier 3.

Figure 14:
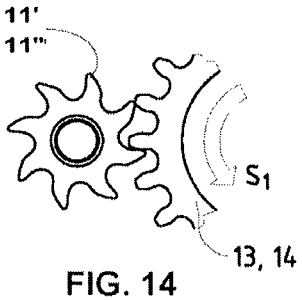
FIGS. 14 and 15: diagrams showing locking or otherwise of satellite-input wheel drive.
Figure 15:
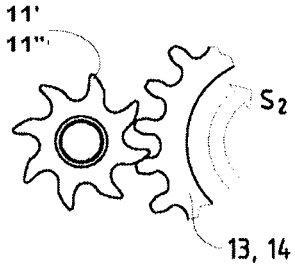

In FIGS. 14 and 15, it can be seen that when the external toothings 13, 14 rotate in a first direction S1, locking of the satellites 11', 11" occurs whereas when the external toothings 13, 14 rotate in a second direction S2, they drive the satellites 11', 11" in rotation.

In general and whatever the embodiment, the satellite carrier carries, as can be seen in FIGS. 5 and 6, a plurality of first satellites and a plurality of second satellites and preferably, for reasons of balancing, as many first satellites as second satellites. At this point, it should be noted that increasing the number of satellites is generally useful for reducing play during a reversal in direction. Consequently, adjusting the number of satellites relative to the number of teeth makes it possible to reduce (or alternatively to increase) backlash (i.e. play) during a reversal in direction as required.

Upstream of the Reverser

As previously stated, a mechanism is provided for driving the input wheels 6 and 12 in rotation in opposite directions.

Figure 12:
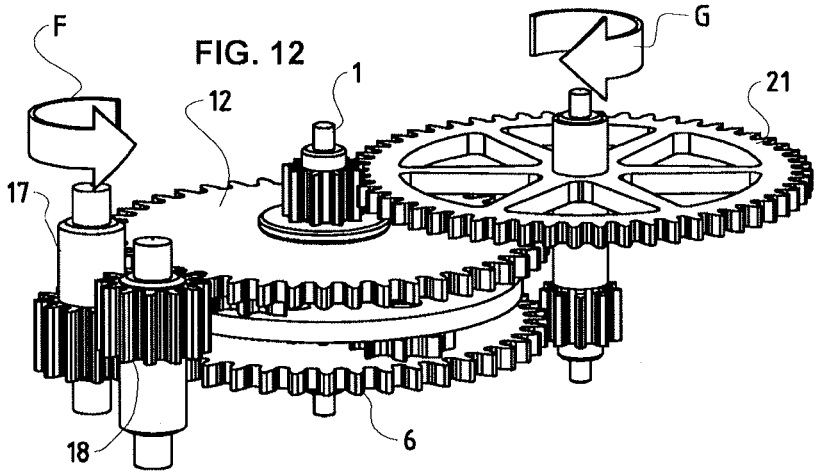
FIGS. 12 and 13: an illustration of the directions of rotation of the parts of the reverser according to the first embodiment of the invention.
Figure 13:
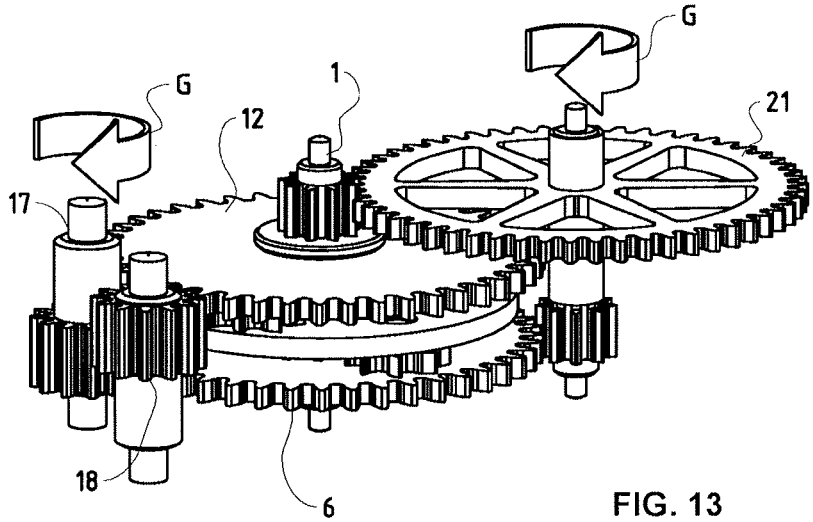

In order to achieve this, a person skilled in the art may consider any appropriate mechanism, in particular a geartrain such as that shown in FIGS. 12 and 13.

A winding pinion 17 driven in rotation by the self-winding weight (not shown) meshes with the first input wheel 6. At the same time, this pinion 17 meshes with a transfer pinion 18 which itself meshes with the second input wheel 12. The toothing of the shaft 1 meshes with an output wheel 21 which thus always rotates in the same direction.

Other Variants

Figure 16:
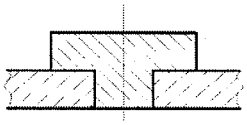
FIGS. 16 to 21: various methods for attaching a satellite to a satellite carrier.
Figure 17:
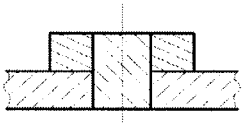
Figure 18:
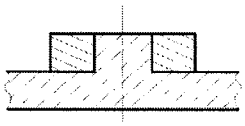
Figure 19:
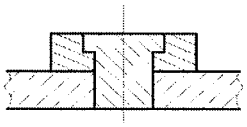
Figure 20:
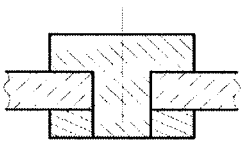
Figure 21:
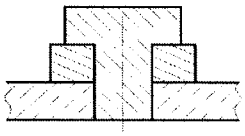

FIGS. 16 to 21 show variants for attaching satellites to a satellite carrier, with axial limitation of satellite displacement (FIGS. 19 to 21) or without such limitation (FIGS. 16 to 18; in this case, axial displacements are limited on either side by the satellite carrier and an input wheel).

The invention claimed is:

1. A reverser comprising:

a first input moving part including a first receiving toothing and integral with a first transmission toothing;

a second input moving part including a second receiving toothing and integral with a second transmission toothing;

a first satellite cooperating with the first transmission toothing configured to rotate in a single direction;

a second satellite cooperating with the second transmission toothing configured to rotate in a single direction, the second satellite being freely rotatable relative to the first satellite;

a satellite carrier carrying the second satellite; and an output moving part integral with the satellite carrier, wherein the first satellite is carried by the satellite carrier.

2. The reverser according to claim 1, wherein the first and second input moving parts are coaxial.

3. The reverser according to claim 1, wherein the first and second transmission toothings are internal toothings.

4. The reverser according to claim 3, wherein the first and second satellites are coaxial.

5. The reverser according to claim 1, wherein satellite carrier is coaxial with the output moving part.

6. The reverser according to claim 1, wherein the satellite carrier is coaxial with at least one of the first input moving part and the second input moving part.

7. The reverser according to claim 1, wherein the first and second satellites have separate pivot axes.

8. The reverser according to claim 1, wherein the first and second satellites are configured to cooperate with the first and second transmission toothings, respectively, so as to rotate in opposite directions.

9. The reverser according to claim 1, wherein the first and second input moving parts, the satellite carrier and the output moving part are coaxial.

10. The reverser according to claim 1, wherein the satellite carrier carries a plurality of pairs of first and second satellites.

11. A self-winding watch comprising a reverser according to claim 1.

12. The self-winding watch according to claim 11, further comprising:

a mechanism configured to drive the input moving parts in rotation in opposite directions.

* * * * *